US005702024A

United States Patent [19]

Riso

[11] Patent Number: 5,702,024

[45] Date of Patent: Dec. 30, 1997

[54] ICE BLOCKING CUP LID

[76] Inventor: Frank E. Riso, 2324 Metairie Heights Ave., Metairie, La. 70001-2142

[21] Appl. No.: 584,099

[22] Filed: Jan. 11, 1996

[51] Int. Cl.[6] ..... A47G 19/22

[52] U.S. Cl. ..... 220/704; 220/719; 220/731

[58] Field of Search ..... 220/695, 700, 220/702, 704, 716, 719, 731

[56] References Cited

U.S. PATENT DOCUMENTS

| | | | |
|---|---|---|---|
| 214,063 | 4/1879 | Thatcher et al. | 220/704 |
| 408,013 | 7/1889 | Hibbard | 220/704 |
| 440,541 | 11/1890 | Chandler | 220/704 |
| 441,911 | 12/1890 | Ware | 220/704 |
| 927,892 | 7/1909 | Steele, Jr. | 220/704 |
| 3,944,112 | 3/1976 | Miller | 220/704 |

FOREIGN PATENT DOCUMENTS

| | | | |
|---|---|---|---|
| 12371 | of 1892 | United Kingdom | 220/704 |

*Primary Examiner*—Stephen Cronin

[57] ABSTRACT

An ice blocking cup lid for use in association with a cup including a rim, ice cubes and fluid, the apparatus comprising: at least one plate formed in a planar configuration and including a front section, the plate including coupling devices to permit coupling to the rim of a cup, each plate being retained within the cup below the rim.

4 Claims, 3 Drawing Sheets

ICE BLOCKING CUP LID

BACKGROUND OF THE INVENTION

1. Field of the Invention

The present invention relates to a ice blocking cup lid and more particularly pertains to coupling the apparatus to a beverage cup to prevent ice spillage when drinking from the cup.

2. Description of the Prior Art

The use of ice retaining devices is known in the prior art. More specifically, ice retaining devices heretofore devised and utilized for the purpose of retaining ice within beverage containers are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 5,341,657 to Fuller a beverage cooler and container apparatus.

U.S. Pat. No. 5,284,028 to Stuhmer discloses an ice holder incorporated within a beverage container.

U.S. Pat. No. 4,485,637 to Campbell discloses a drinking mug.

U.S. Pat. No. 5,299,716 to Hawkins discloses an ice dispenser with an ice flow regulator.

U.S. Pat. No. 5,148,973 to Zimmermann discloses an interlocking carton and lid.

Lastly, U.S. Pat. No. 4,402,195 to Campbell discloses a drinking mug.

In this respect, the ice blocking cup lid according to the present invention substantially departs from the conventional concepts and designs of the prior art, and in doing so provides an apparatus primarily developed for the purpose of coupling the apparatus to a beverage cup to prevent ice spillage when drinking from the cup.

Therefore, it can be appreciated that there exists a continuing need for a new and improved ice blocking cup lid which can be used for coupling the apparatus to a beverage cup to prevent ice spillage when drinking from the cup. In this regard, the present invention substantially fulfills this need.

SUMMARY OF THE INVENTION

In view of the foregoing disadvantages inherent in the known types of ice retaining devices now present in the prior art, the present invention provides an improved ice blocking cup lid. As such, the general purpose of the present invention, which will be described subsequently in greater detail, is to provide a new and improved ice blocking cup lid and method which has all the advantages of the prior art and none of the disadvantages.

To attain this, the present invention essentially comprises a new and improved ice blocking cup lid for use in association with a cup including a rim, ice cubes and fluid, the apparatus comprising, in combination: a first plate and a second plate, each plate being fabricated of plastic and formed in a planar configuration with convex inboard, outboard and rear sides, each member further including a concave front side, an upper surface and a lower surface, each front side including three spaced apertures positioned therealong, the first plate being positioned above the second plate with the inboard end of the first plate overlapping the inboard end of the second plate, the members being positioned whereby at least one aperture of the first plate being positioned in alignment with at least one aperture of the second plate; a pin being fabricated of plastic and pivotally and releasably coupled through the aligned apertures to permit pivotal movement of the first and second plates with respect to each other; and each outboard side edge including an inverted U-shaped clip affixed thereto adjacent to the rear edge, each clip being fabricated of plastic, in an operative orientation the clips of each member being coupled to the rim of a cup, the slidably adjustable configuration of the apparatus permitting coupling to a plurality of differently sized cups, the apparatus serving to block ice cubes when a user drinks from a cup including fluid and ice cubes.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved ice blocking cup lid which has all of the advantages of the prior art ice retaining devices and none of the disadvantages.

It is another object of the present invention to provide a new and improved ice blocking cup lid which may be easily and efficiently manufactured and marketed.

It is further object of the present invention to provide a new and improved ice blocking cup lid which is of durable and reliable constructions.

An even further object of the present invention is to provide a new and improved ice blocking cup lid which is susceptible of a low cost of manufacture with regard to both materials and labor, and which accordingly is then susceptible of low prices of sale to the consuming public, thereby making such ice blocking cup lid economically available to the buying public.

Still yet another object of the present invention is to provide a new and improved ice blocking cup lid which provides in the apparatuses and methods of the prior art some of the advantages thereof, while simultaneously overcoming some of the disadvantages normally associated therewith.

Still another object of the present invention is to couple the apparatus to a beverage cup to prevent ice spillage when drinking from the cup.

Lastly, it is an object of the present invention to provide a new and improved ice blocking cup lid for use in association with a cup including a rim, ice cubes and fluid, the apparatus comprising: at least one plate formed in a planar configuration and including a front section, the plate including coupling devices to permit coupling to the rim of a cup, each plate being retained within the cup below the rim.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
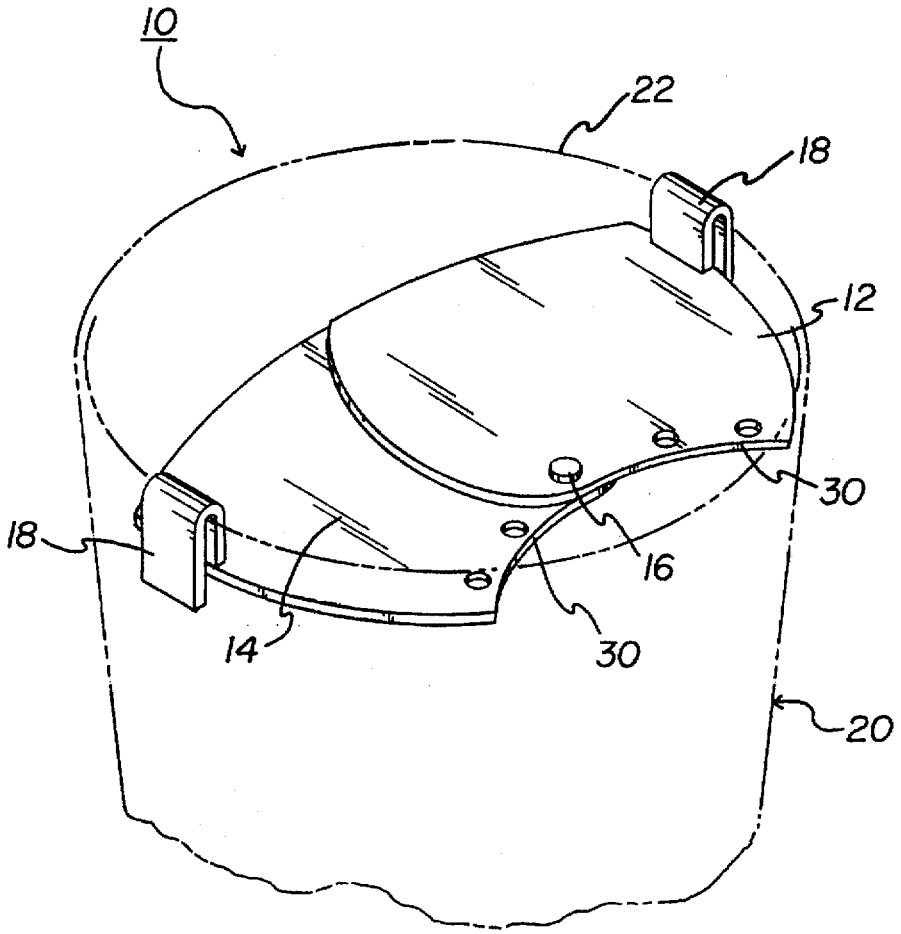
FIG. 1 is a perspective view of the preferred embodiment of the ice blocking cup lid constructed in accordance with the principles of the present invention.

With reference now to the drawings, and in particular to FIG. 1 thereof, the preferred embodiment of the new and improved ice blocking cup lid embodying the principles and concepts of the present invention and generally designated by the reference numeral 10 will be described.

The present invention, the ice blocking cup lid 10 is comprised of a plurality of components. Such components in their broadest context include a first plate 12, a second plate 14, a pin 16 and two inverted U-shaped clips 18. Such components are individually configured and correlated with respect to each other so as to attain the desired objective.

Figure 2:
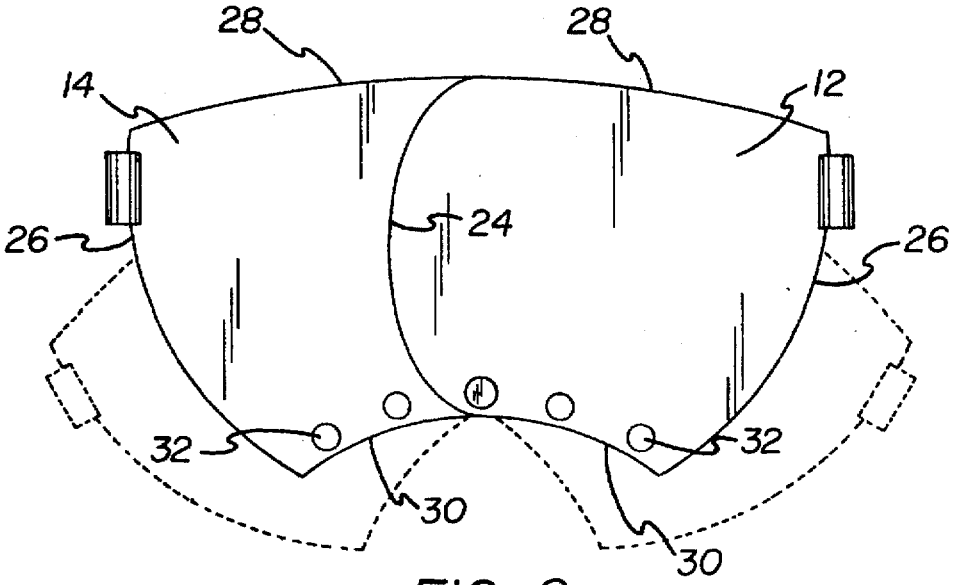
FIG. 2 is a top plan view of the apparatus shown in FIG. 1 illustrating the range of pivotal movement of the plates.

The ice blocking cup lid is adapted for use in association with a conventional beverage cup 20 including a rim 22 at its uppermost extent. The cup includes ice cubes and beverage within it. A first plate 12 and a second plate 14 are included with the apparatus. Each plate is fabricated of plastic and formed in a planar configuration with convex inboard 24, outboard 26 and rear 28 sides. Each member further includes a concave front side 30, an upper surface and a lower surface. The front side includes three spaced apertures 32 positioned along it. Note FIGS. 1 and 2.

The first plate is positioned above the second plate, with the inboard end of the first plate overlapping the inboard end of the second plate. The members are positioned so that least one aperture of the first plate is positioned in alignment with at least one aperture of the second plate. A pin 16 is pivotally and releasably coupled through the aligned apertures to permit pivotal movement of the first and second plates with respect to each other. With the inboard apertures coupled together the members can be pivoted to a combined length ranging between 2¼ and 4¼ inches. Additionally, a user may align the other apertures of the first and second members to further reduce the combined length of the plates. The adjustability of the plates permits coupling to a plurality of differently sized cups. Note FIGS. 1 and 2.

An inverted U-shaped clip 18 affixed to the each outboard side edge adjacent to each rear edge. In an operative orientation the clips of each member are coupled to the rim of a cup. The slidably adjustable configuration of the apparatus permits coupling to a plurality of differently sized cups. The apparatus serves to block ice cubes when a user drinks from a cup which includes beverage and ice cubes. The overlapping concave front edges of each plate, along with the rim of the cup, define the boundaries of an elliptical space for the passage of beverage. The elliptical space conforms to the shape of a user'mouth. The apparatus prevents ice cubes from passing through the elliptical space, thereby preventing spillage and splashing of ice cubes and beverage outside of the cup. Note FIGS. 1 and 2.

Figure 3:
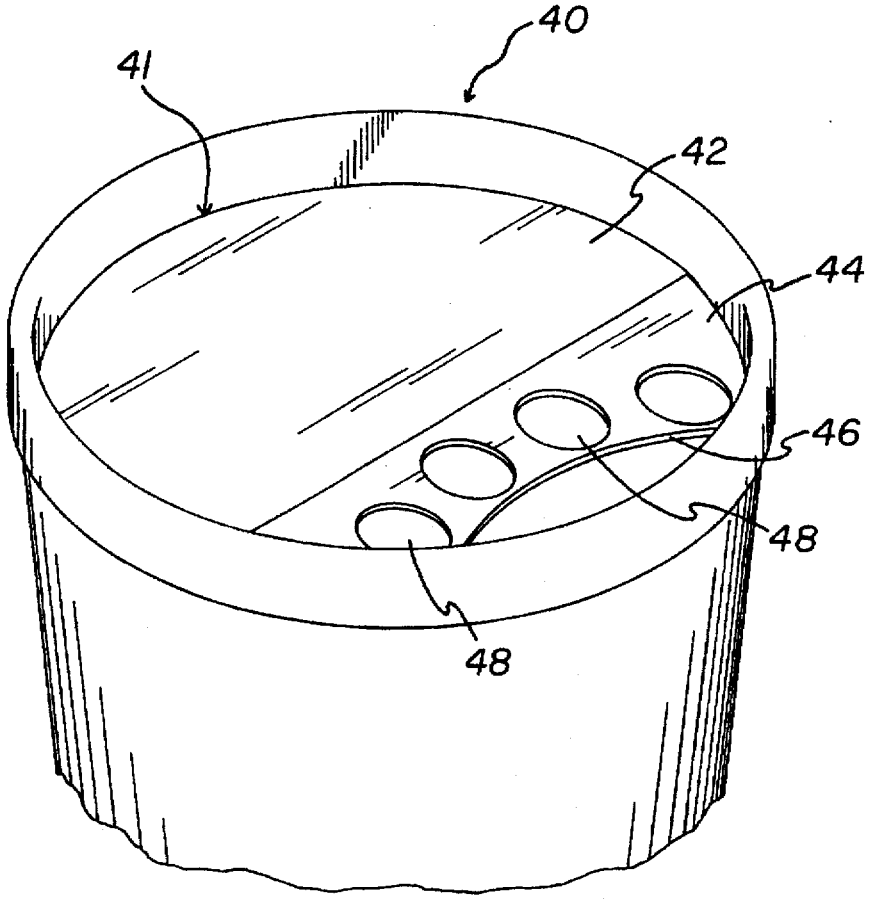
FIG. 3 is a perspective view of the first alternative embodiment of the apparatus.
Figure 5:
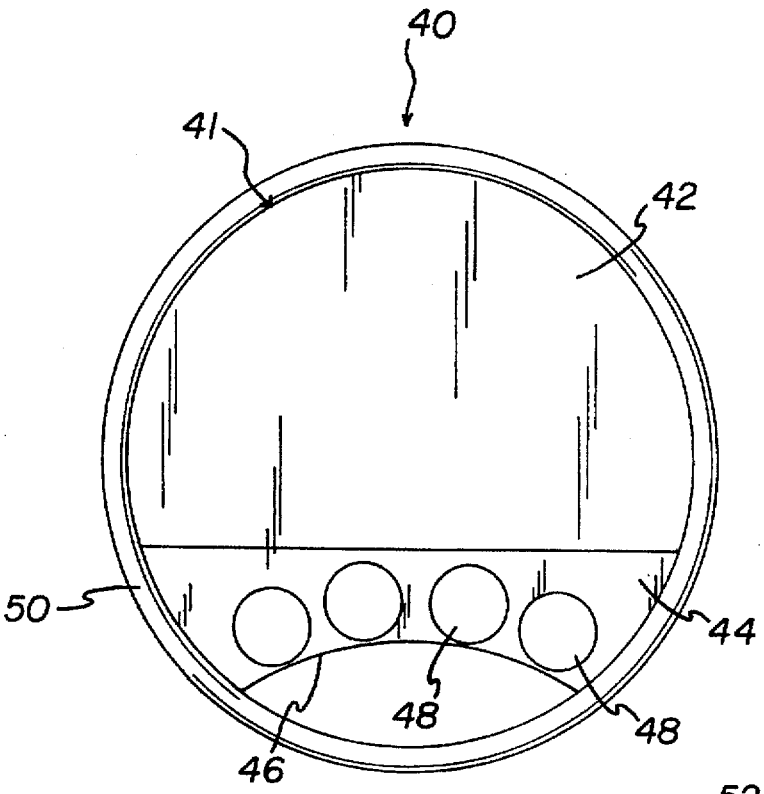
FIG. 5 is a top plan view of the first alternative embodiment of the apparatus.
Figure 6:
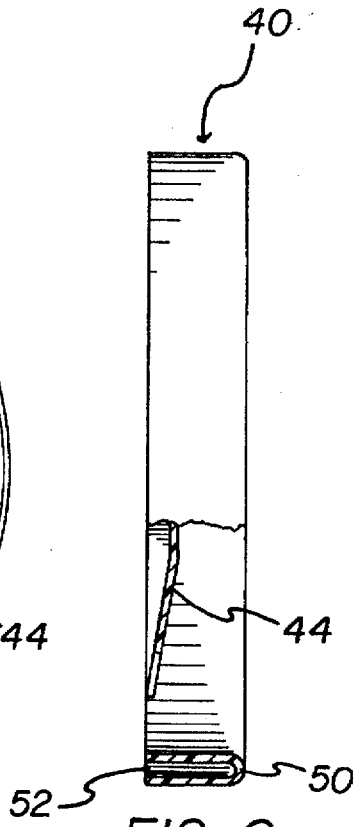
FIG. 6 is a side plan view of the first alternative embodiment of the apparatus illustrating the angle of the front section and configuration of the flange.

FIGS. 3, 5 and 6 illustrate a first alternative embodiment of the apparatus 40. In such embodiment the ice blocking cup lid includes a plate 41 formed in a planar, generally circular configuration with an upper surface and a lower surface. The plate further includes a horizontal rear section 42. The plate has a front section 44 with a concave front edge 46 and four circular apertures 48 positioned therealong. The front section is angled downwardly with respect to the rear section of the plate. The plate includes a cylindrical flange 50 with a rounded upper extent and a lower extent which includes a recess 52. The flange is coupled to the rim of a cup by simply positioning the flange over the equally sized rim of the cup. The first alternate embodiment is a single purpose, custom made device which is fabricated of glass or plastic. The first alternate embodiment is fabricated in a plurality of different sizes to permit coupling to the rims of cups fabricated of similar materials. Note FIGS. 3, 5 and 6.

Figure 4:
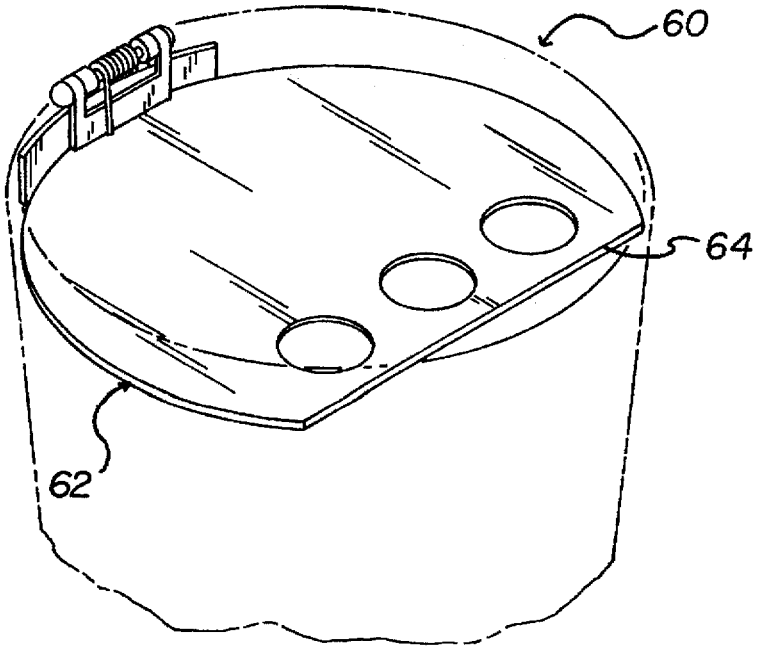
FIG. 4 is a perspective view of the second alternative embodiment of the apparatus.
Figure 7:
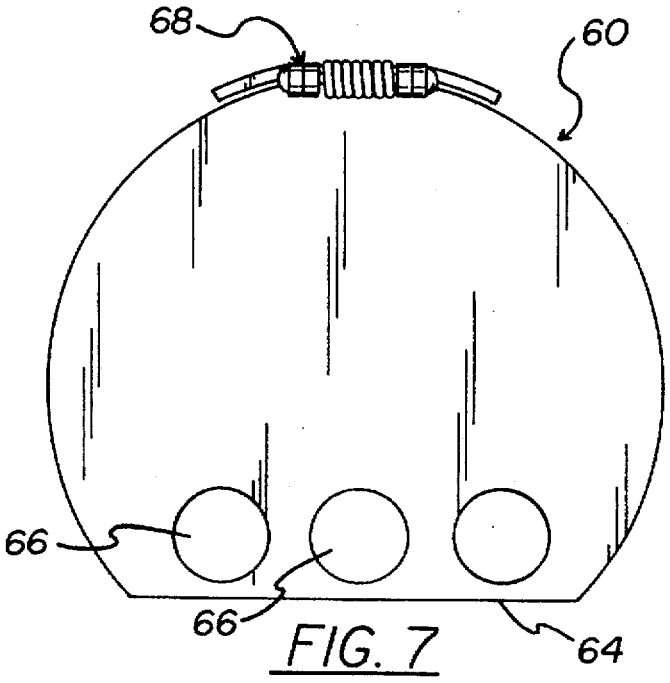
FIG. 7 is a top plan view of the second alternative embodiment of the apparatus shown in FIG. 4.
Figure 8:
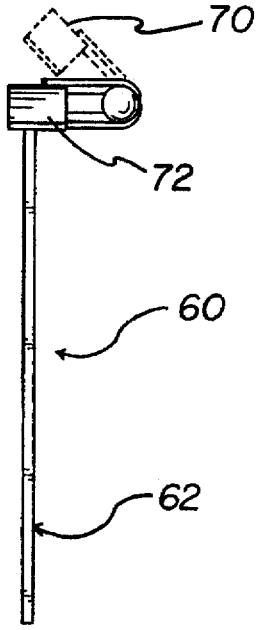
FIG. 8 is a side plan view of the second alternative embodiment of the apparatus illustrating the configuration of the spring mounted hinge.

FIGS. 4, 7 and 8 illustrate a second alternative embodiment of the apparatus 60. In such embodiment the ice blocking cup lid includes a plate 62 formed in a generally circular configuration with a linear front section 64 the linear front section includes three circular apertures 66 positioned along it. The plate has a rear extent which includes a spring loaded hinge 68. The hinge has a rear segment 70 and a front segment 72. The front and rear segments are coupled around the rim of a cup in an operative orientation. The second alternative embodiment is easily attached to a cup by simply separating the front and rear segments of the hinge and clipping them around the rim of the cup. Note FIGS. 4, 7 and 8.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A ice blocking cup lid for use in association with a cup including a rim, ice cubes and fluid, the apparatus comprising, in combination:

a first plate and a second plate, each plate being fabricated of plastic and formed in a planar configuration with convex inboard, outboard and rear sides, each member further including a concave front side, an upper surface and a lower surface, each front side including three spaced apertures positioned therealong, the first plate being positioned above the second plate with the inboard end of the first plate overlapping the inboard end of the second plate, the members being positioned whereby at least one aperture of the first plate being positioned in alignment with at least one aperture of the second plate;

a pin being fabricated of plastic and pivotally and releasably coupled through the aligned apertures to permit pivotal movement of the first and second plates with respect to each other; and each outboard side edge including an inverted U-shaped clip affixed thereto adjacent to the rear edge, each clip being fabricated of plastic, in an operative orientation the clips of each member being coupled to the rim of a cup, the slidably adjustable configuration of the apparatus permitting coupling to a plurality of differently sized cups, the apparatus serving to block ice cubes when a user drinks from a cup including fluid and ice cubes.

2. An ice blocking cup lid for use in association with a cup including a rim, ice cubes and fluid, the apparatus comprising:

a plate formed in a planar configuration and including a front section, the plate including coupling devices to permit coupling to the rim of a cup, the plate being retained within the cup below the rim, the plate having a linear front section including three circular apertures positioned therealong, the plate having a rear extent including a spring loaded hinge, the hinge having a rear segment and a front segment, the front and rear segments being coupled around the rim of a cup in an operative orientation.

3. An ice blocking cup lid for use in association with a cup including a rim, ice cubes and fluid, the apparatus comprising:

at least one plate formed in a planar configuration and including a front section, the plate including coupling devices to permit coupling to the rim of a cup, each of said at least one plate being retained within the cup below the rim; said at least one plate comprising first and second plates, each plate having a concave front edge with a plurality of apertures positioned therealong, each plate having an outboard edge with an inverted U-shaped clip affixed thereto, the first plate being positioned above the second plate with at least one aperture of the first plate being positioned in alignment with at least one aperture of the second plate, a pin being pivotally and releasably coupled through the aligned apertures to permit pivotal movement of the first and second plates with respect to each other.

4. An ice blocking cup lid for use in association with a cup including a rim, ice cubes and fluid, the apparatus comprising:

a plate formed in a planar configuration and including a front section, the plate including coupling devices to permit coupling to the rim of a cup, the plate being retained within the cup below the rim, the plate having an upper surface and a lower surface, the plate including a rear section with a horizontal plane, the front section having a concave front edge with four circular apertures positioned therealong, the front section being angled downwardly with respect to the rear section of the plate, the plate including a cylindrical flange with a rounded upper extent and a lower extent including a recess, the flange adapted to be coupled to the rim of a cup in an operative orientation.

* * * * *